US005118951A

United States Patent [19]

Kherani et al.

[11] Patent Number: 5,118,951

[45] Date of Patent: Jun. 2, 1992

[54] RADIOLUMINESCENT LIGHT SOURCES

[76] Inventors: Nazir P. Kherani, 360 Bloor Street East, Suite 1506, Toronto, Ontario, Canada, M4W 3M3; Walter T. Shmayda, 240 Melrose Avenue, King City, Ontario, Canada; Stefan Zukotynski, 32 Maryvale Crescent, Richmond Hill, Ontario, Canada, L4C 6P8

[21] Appl. No.: 583,209

[22] Filed: Sep. 17, 1990

[51] Int. Cl.[5] ..... H01J 65/00

[52] U.S. Cl. ..... 250/462.1; 250/486.1; 250/493.1; 250/483.1; 313/54

[58] Field of Search ..... 250/483.1, 484.1, 493.1, 250/485.1, 462.1, 486.1, 487.1, 503.1; 313/54

[56] References Cited

U.S. PATENT DOCUMENTS

| | | | |
|---|---|---|---|
| 4,788,437 | 11/1988 | Urquhart et al. | 250/486.1 |
| 4,855,879 | 8/1989 | Soltani et al. | 362/84 |
| 4,935,632 | 6/1990 | Hart | 250/493.1 |

*Primary Examiner*—Constantine Hannaher
*Assistant Examiner*—James E. Beyer
*Attorney, Agent, or Firm*—Ridout & Maybee

[57] ABSTRACT

A radioluminescent source is provided by a radioactive element entrapped in an amorphous semiconductor. A preferred light source comprises a beta-emitting radioactive element, such as tritium, occluded within a matrix of amorphous semiconductor material, such as amorphous silicon, with or without dopants. The matrix may serve as an intrinsic radioluminescent light source, or as an electron source to irradiate a separate phosphor.

11 Claims, 4 Drawing Sheets

RADIOLUMINESCENT LIGHT SOURCES

FIELD OF THE INVENTION

This invention relates to radioluminescent light sources and is particularly concerned with radioluminescent light sources which are powered by tritium. However, the invention is also applicable to radioluminescent light sources in which a radioactive element other than tritium is used as a source of electrons or other subatomic particiles for excitation of a phosphor.

BACKGROUND OF THE INVENTION

Radioluminescence pertains to the generation of light by the excitation of a phosphor, more particularly from a radioactive source. The first application of radioluminescence was to luminous paints to be used on watches, clocks, aircraft dials and the like, the paints incorporating an intimate mixture of radium and a zinc sulphide phosphor. With the recognition of the deleterious effects of radium on humans and the increasing availability of other potential radionuclides such as promethium-147, krypton-85 and tritium, the usage of radium for this purpose diminished. Nowadays, radioluminescent lights, used for maintenance-free illumination, are mainly powered by tritium. Examples of the use of tritium in applications of radioluminescence are to be found, for example, in U.S. Pat. Nos. 3,176,132, 3,260,846, 3,478,209 and 4,677,008.

The earliest tritium light sources were in the nature of radioluminescent paints, tritium being substituted for hydrogen in an organic resin used also as a binder to couple it with a zinc sulphide phosphor. Such light sources were inefficient, however, on account of the opacity of the resin and also the tendency to desorption of the tritium out of the resin. Subsequently, the most commonly used tritium light sources took the form of phosphor coated glass tubes filled with tritium gas. While these light sources are generally superior to the radioluminescent paints, both in ease of fabrication and in the more efficient use of tritium decay betas, they have their shortcomings. Specifically, there are inherent limitations on the efficiency which can be achieved in these devices owing to the loss of energy of the decay betas as they traverse the tritium gas as well as the low photon efficiency and self-absorption by the phosphor. Because of these inherent limitations, significant effort has been devoted to the development and application of configurational and optical techniques for the optimization of luminous exitance.

Notwithstanding the above-mentioned developments, present day usage of radioluminescence is limited to only a few applications. The limitation on the use of radioluminescence in many applications in which such use would be desirable is due to a failure to address two fundamental problems, namely (i) how to transmit the decay betas to the phosphorescent medium with negligible loss of energy, and (ii) how to convert the beta energy to light with minimum self-absorption by the phosphor.

SUMMARY OF THE INVENTION

The above-mentioned limitations are largely overcome, according to one aspect of the present invention, by constructing an intrinsic radioluminescent source consisting essentially of a thin, substantially transparent, film of amorphous semiconductor containing occluded tritium, the film being deposited on a transparent substrate or alternatively upon a substrate providing reflecting surfaces configured to concentrate the generated light and direct it in a desired direction.

Alternatively, according to another aspect of the invention, the deposited thin, substantially transparent, film containing occluded tritium may be used as an electron source to excite a deposited phosphor layer.

The amorphous semiconductor may be for example, an amorphous silicon-tritium alloy (a-Si:T) produced by glow discharge decomposition of tritiated silane ($SiT_4$) in a d.c. saddle field. By incorporating suitable dopants, or by alloying with elements, such as germanium, carbon and/or nitrogen, the colour or wavelength range of the resultant light can be tailored to suit requirements.

According to yet another aspect of the invention, a radioactive element other than tritium, for example $C_{14}$ entrapped in the amorphous semiconductor matrix, may serve as the excitation source.

BRIEF DESCRIPTION OF THE DRAWINGS

Examples of the application of the invention to commercially useful radioluminescent devices of enhanced efficiency will now be described, by way of example, with reference to the accompanying drawings. In the drawings.

DESCRIPTION OF THE PREFERRED EMBODIMENTS

General

Figure 1:
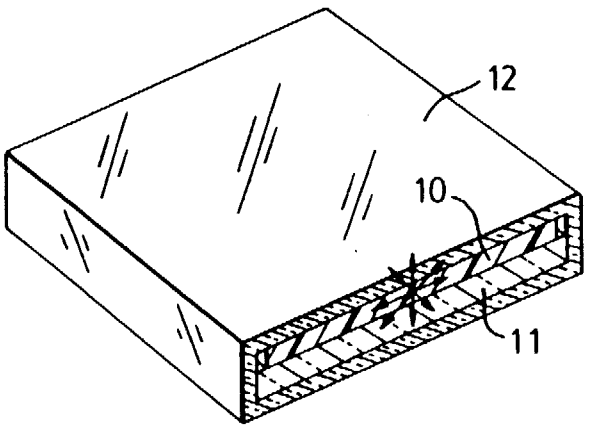
FIG. 1 is a cross-sectional view of a radioluminescent light source according to one embodiment of the invention.

The present invention, as applied to tritium-powered radioluminescent light sources, is based essentially on the use of thin films of tritium-occluded amorphous semiconductor, (herein referred to as TAS films,) deposited on suitable substrates which are themselves transparent to appropriate wavelengths, or which provide highly reflective surfaces on which the films are deposited. The TAS film can be deposited using one of several commercially available techniques; for example, by glow discharge decomposition of precursor gases to produce semiconductor materials. Tritium decay betas with a mean energy of 5.7 keV will traverse through a TAS film losing energy to the formation of electron-hole pairs and Bremmstrahlung radiation until they are thermalized and combine with positive charges. The recombination of the electron-hole pairs gives rise to characteristic luminescence consistent with the band gap of the tritiated amorphous semiconductor. Use of various alloying or doping elements at different concentration levels will vary the band gap or provide band gap states and therefore change the wavelength of the emitted light. Thus, one may select any wavelength from infra-red to the ultra-violet.

Selection of Materials

The preferred TAS is tritiated amorphous silicon (a-Si:T). In recent years, hydrogenated amorphous silicon (a-Si:H) has generated considerable interest. This interest has been spurred, in large measure, by its potential for optoelectronic applications. The interatomic bonding in a-Si is similar to that of crystalline Si. As a result the ranges of allowed energy states are similarly distributed in the two materials. However, because of the lack of long range periodicity in a-Si the k-conservation rules are relaxed for optical transitions and consequently a-Si behaves like a direct gap semiconductor, whereas crystalline silicon is an indirect gap material in the Bloch function representation. It is this direct gap behaviour of a-Si that places it in the group of optoelectronic materials, together with GaAs.

Many of the gap states that exist in a-Si, because of its defect nature, can be eliminated by alloying with hydrogen. Typicaly 10 to 25 atomic % hydrogen is introduced into a-Si:H to obtain material with good optoelectronic properties. It should be emphasized, that although the electronic properties of the silicon hydrogen bonds are influenced by exposure to high levels of illumination, the bond is strong enough that hydrogen is chemically stable in a-Si:H to temperatures above 300° C. The energy gap of a-Si:H with hydrogen content in the range from 10 to 25 atomic % increases from about 1.7 to 2.0 eV respectively. It can also be increased by alloying with carbon (a-Si:C:H) or nitrogen (a-Si:N:H) or decreased by alloying with germanium (a-Si:Ge:H).

A-Si:H can be deposited in the form of large area thin films onto a wide variety of low-cost substrates, such as glass, using low-temperature processing techniques (typically below 350° C.). This makes a-Si:H the ideal candidate for many large surface area device applications. Although a number of different techniques have been developed for the preparation of a-Si:H thin films, the best quality a-Si:H is generally produced through the glow discharge decomposition of silane ($SiH_4$). This can be attributed to the fact that both "activated" hydrogen and $SiH_n$ radicals are present during the discharge deposition, and as a result, improvements in the growth kinetics and passivation of the electrically-active defects are manifest.

A process, based on the principle of an electrostatic field supported charged particle oscillator, involves the use of glow discharge decomposition of silane in a d.c. saddle field. This process combines many of the positive attributes of both r.f. and d.c. diode discharge techniques. The electrode configuration consists of an anode in the form of a stainless steel annular ring supporting a loosely woven stainless steel wire grid held by an insulating support between two additional stainless steel annular rings, of the same diameter, strung with similar stainless steel wire grids. The two outside rings are grounded, and thus form the cathodes of a symmetrical saddle field cavity. The heated substrate holders are mounted next to the cathodes. They may be raised to a positive or negative potential. Silane, silane with phosphine, silane with diborane, methane, hydrogen, nitrogen and argon are admitted into the chamber through a multi-channel mass flow controlled manifold. Co-evaporation with silicon or dopants and alloying elements can be performed.

The d.c. saddle field electrode configuration facilitates discharge formation over a wide range of pressures, from over 500 mTorr down to a few mTorr and even lower, while avoiding the tuning problems that plague the conventional r.f. techniques. Film growth in the r.f. discharges is largely controlled indirectly by the induced d.c. field. The d.c. saddle field electrode configuration provides a similar d.c. potential distribution, but with direct controllability.

A-Si:H films that are mechanically stable, free of flaking or blistering, with good adherence to the substrate, can be simultaneously deposited onto both conducting and insulating substrates, using a discharge in silane, ignited in a d.c. saddle field plasma chamber. The high discharge current that can be obtained, using a saddle field electrode configuration at relatively low pressures in order to minimize polymerization effects, allows for the deposition of semiconductor quality a-Si:H films at relatively high rates, in excess of 5 Å/sec, as compared to about 2 to 3 Å/sec using prior technology. Recently, films have been produced with photoconductive gains of $2\times10^4$ at AM1 illumination, and dark resistivities of $5\times10^{10}$ Ωcm.

Hydrogen incorporation can be controlled through the deposition conditions. For example, at a given deposition temperature, the relative fraction of hydrogen incorporated into monohydride and dihydride sites can be varied via the discharge voltage and pressure; higher voltages (i.e. higher than 1000 V), and lower pressures (i.e. less than 50 mTorr), enhance the incorporation of hydrogen into dihydride sites, particularly at low substrate temperatures (i.e. $T_s \leqq 300°$ C.).

A-Si:H exhibits very strong photoluminescence at temperatures below 150K and still significant luminescence at room temperature. Electroluminescence has been observed in a-Si:H p-i-n diodes. The peak luminescence of a-Si-H lies in the infrared, at about 1.3 eV. However by alloying with carbon or nitrogen the energy gap of amorphous silicon can be increased to over 4 eV, and this way the electroluminescent peak can be moved into the visible part of the spectrum. Indeed, recently emission throughout the entire visible spectrum has been reported for a-Si:C:H p-i-n diodes (maximum luminance of 30 cd/m$^2$ and efficiency of $10^{-4}$ lm/W at room temperature).

By the processes mentioned above, tritiated amorphous silicon (a-Si:T) films can be formed on a substrate, or films of related alloys involving silicon carbide and silicon nitride may be formed. The material of the substrate may be glass, sapphire, quartz etc.

The Embodiments

In the accompanying drawings the same reference numerals are used throughout to denote corresponding parts.

FIG. 1 shows a TAS film 10 of a few microns in thickness deposited on a substrate 11 of glass, quartz or sapphire. The substrate is in the form of a plate about 1 mm thick. The film 10 is substantially transparent to the light which is produced, the light being radiated in all directions as indicated by arrows. This device, representing the invention in its simplest form, is encased in a sealed transparent casing 12.

Figure 2:
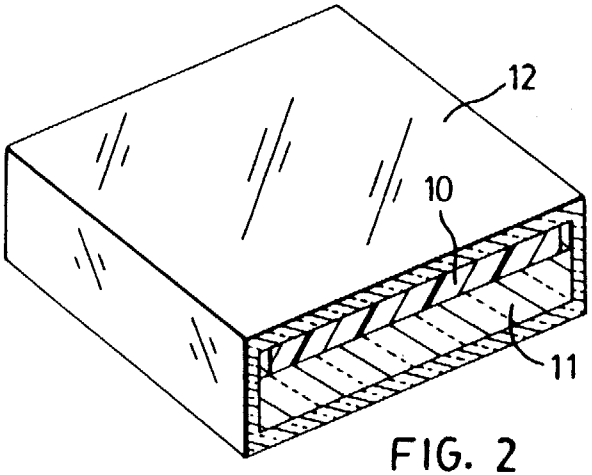
FIG. 2 is a cross-sectional view of a modified radioluminescent light source in which the tritium concentration in the amorphous semiconductor is graded.
Figure 2A:
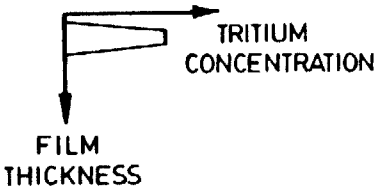
FIG. 2*a* is a diagram showing the distribution of the tritium concentration in the semiconductor.

In the embodiment of FIG. 1 the TAS film has a uniformly distributed concentration of tritium, and therefore at the external surfaces of the film there will be a flux of primary and secondary electrons. Thus, the TAS film is an electron source of total current of the order of $nAcm^{-2}$. From the point of view of light production a TAS film with a graded tritium concentration will tend to convert this extra energy to light and so increase the luminous exitance. FIG. 2 shows such a light source, similar to that in FIG. 1, but having a graded tritium concentration which diminishes towards its surfaces, as indicated by the graph of FIG. 2*a*.

Figure 3:
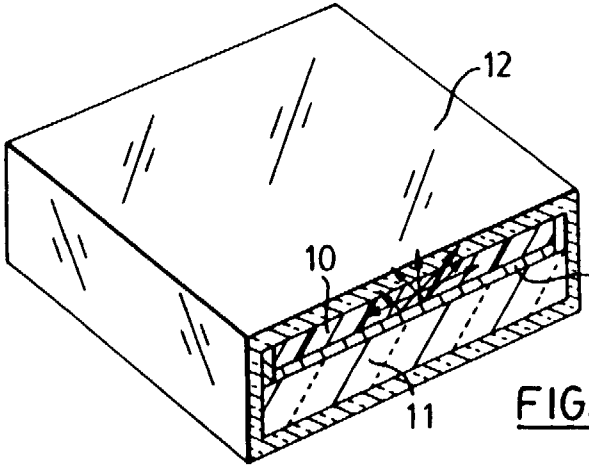
FIG. 3 illustrates, also in partial cross section, yet another embodiment of the invention.

As illustrated in FIG. 3, the luminous flux can be further increased by providing an optically reflective film 13 between the TAS film 10 and the substrate. The reflective film 13, which is of the order of 100 Å in thickness, may be formed by depositing silver, for example, onto the substrate, the TAS film 10 being deposited onto the reflective film. In this embodiment the TAS film preferably has a graded concentration of occuluded tritium as in the case of the embodiment shown in FIG. 2. The produced light which initially travels towards the reflective layer will tend to undergo specular or diffuse reflection, depending on the quality of the reflective film, and thus enhance the luminous exitance, ideally by a factor of two.

Figure 4:
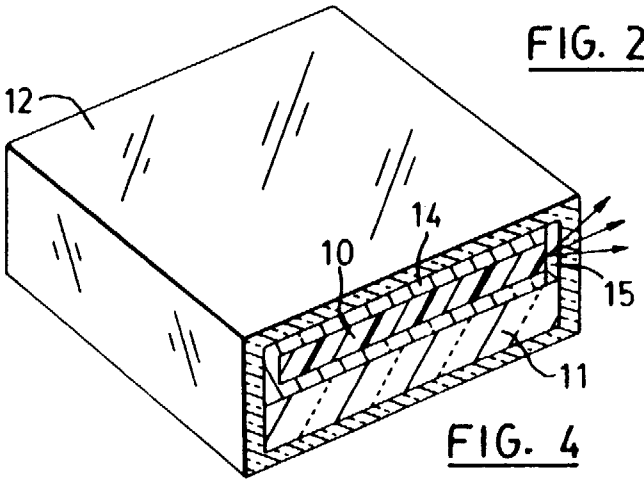
FIG. 4 illustrates, in partial cross section, a modified light source in which the light is concentrated in a selected direction.

As illustrated in FIG. 4, the luminous flux can be further increased by covering all the external surfaces of the graded TAS film 10 with an optically highly reflective film 14 save at one narrow edge. In this case light is concentrated by virtue of total internal reflection, thus giving rise to enhanced luminous exitance at said uncovered narrow edge 15. For total internal reflection to be possible the optically reflective coating must have an index of refraction which is less than that of the graded TAS film. The total light output can be increased by depositing a very large number of alternating layers of optically reflective film 14 and TAS film 10. Such a configuration is illustrated in FIGS. 5 and 6, where FIG. 5 is a general perspective view of the device and FIG. 6 is a greatly enlarged fragmentary view showing the film structure in cross section, the transparent casing being omitted to show the internal structure.

Figure 5:
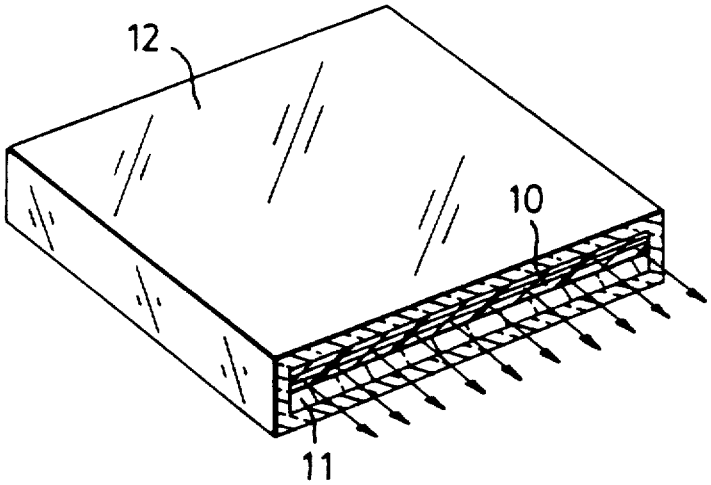
FIG. 5 illustrates a light source similar to that of FIG. 4 but incorporated a plurality of radioluminescent layers.
Figure 7:
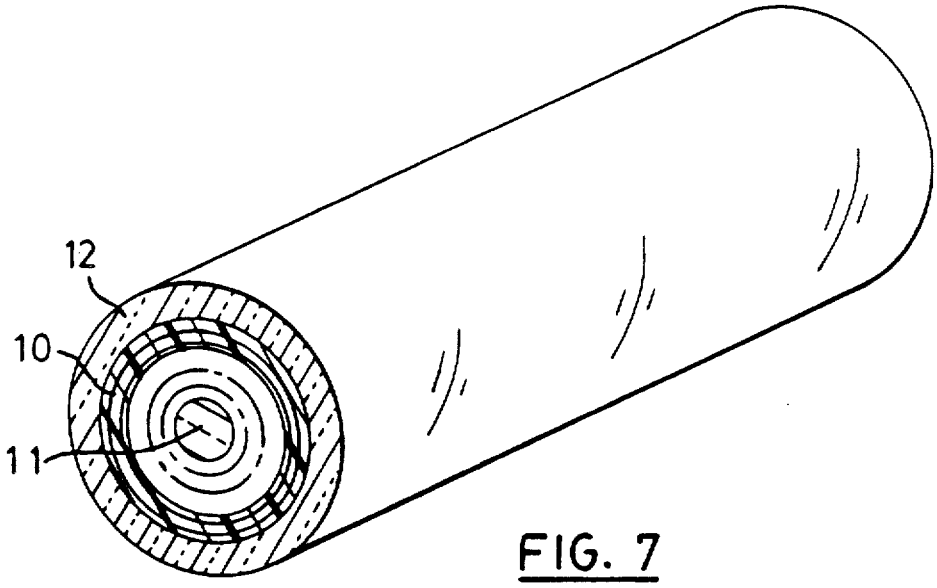
FIG. 7 illustrates another multilayer radioluminescent light source of cylindrical configuration.
Figure 6:
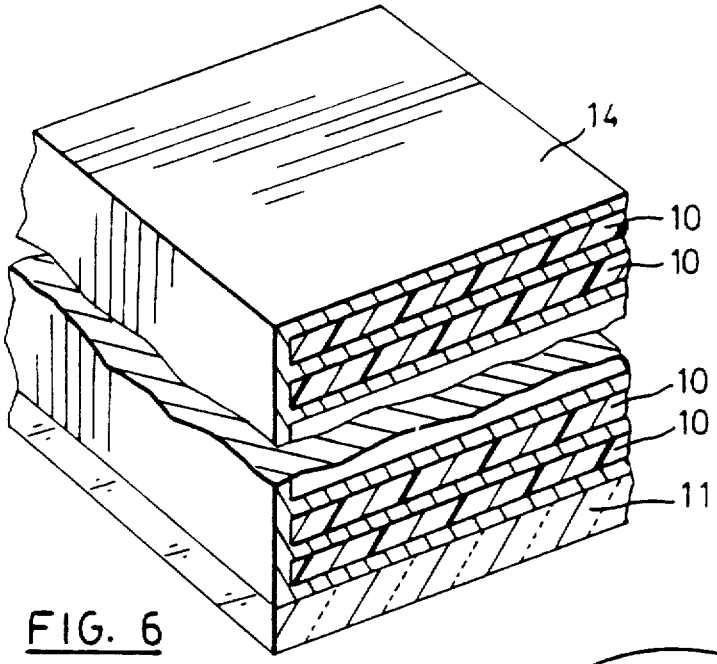
FIG. 6 is an enlarged schematic cross-sectional view of the light source shown in FIG. 5.
Figure 8:
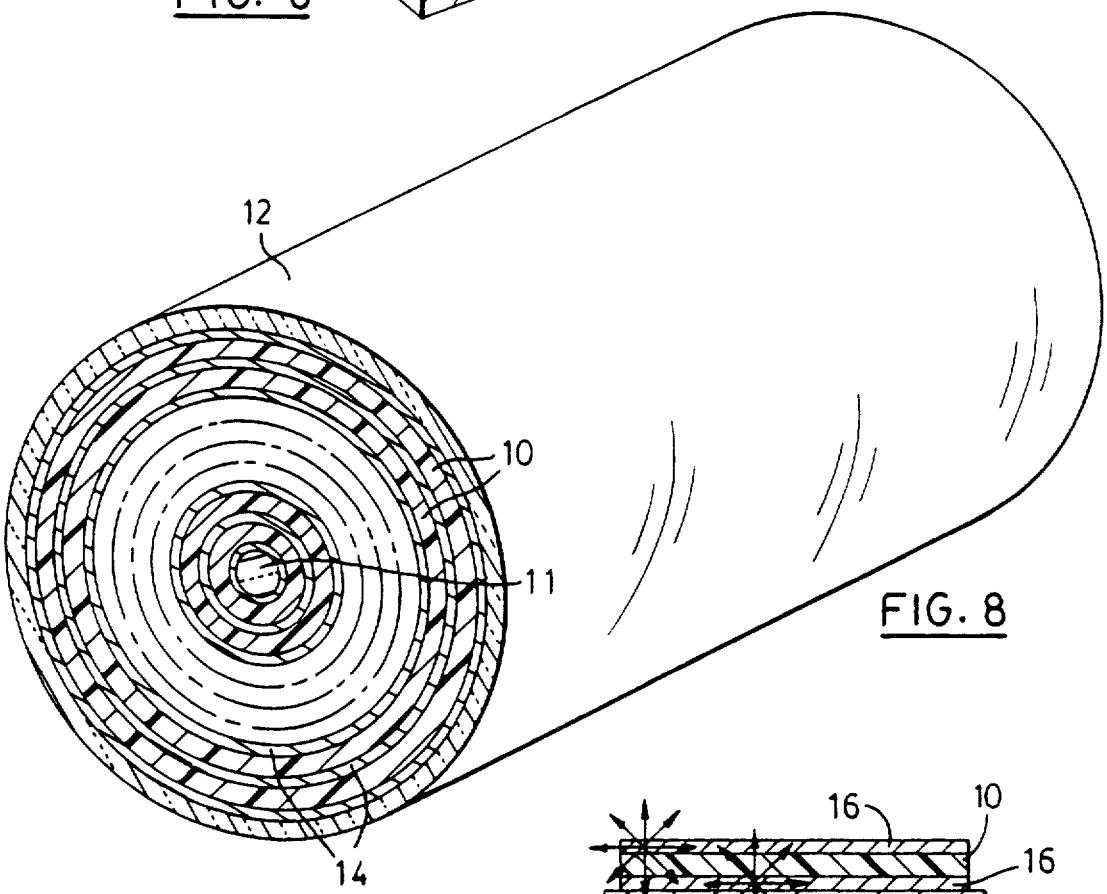
FIG. 8 is an enlarged schematic cross-sectional view of the light source shown in FIG. 7.

It will be appreciated that the geometrical configuration of the composite light source need not be restricted to the rectangular form shown in FIGS. 5 and 6. FIG. 7 shows in perspective a light source having the same multilayer structure as the preceding embodiment of the invention, but of cylindrical configuration. FIG. 8 shows the multilayer structure of the light source in cross section, but with the thicknesses of the reflective and TAS films being greatly exaggerated for clarity.

The light sources described above may be referred to as "intrinsic" light sources, by which is meant that the tritium is occulded within the phosphorescent matrix. No external phosphor is required. In general such an intrinsic light source may be expected to produce a greater luminous exitance than an extrinsic light source. Nevertheless, the availability of a TAS film as an electron source, as previously mentioned in connection with FIG. 1, permits the invention to be applied to an extrinsic light source, given the availability of a phosphor having sufficient quantum efficiency, stability against radiation damage, and desired emission characteristics. FIGS. 9 to 12 illustrate such extrinsic light sources.

Figure 9:
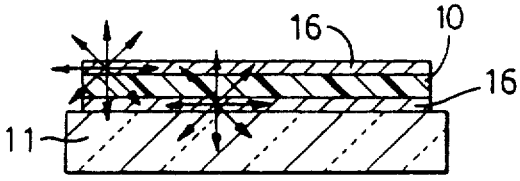
FIG. 9 illustrates a detail of an extrinsic radioluminescent light source according to the invention.
Figure 10:
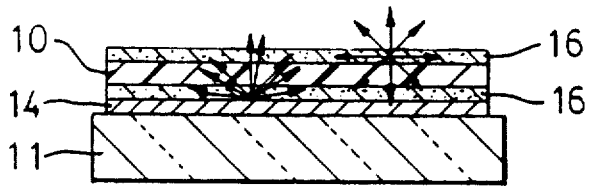
FIG. 10 illustrates a detail of another extrinsic radioluminescent light source according to the invention.
Figure 11:
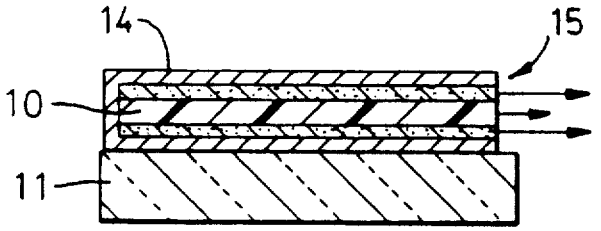
FIG. 11 illustrates a detail of yet another extrinsic radioluminescent light source according to the invention.
Figure 12:
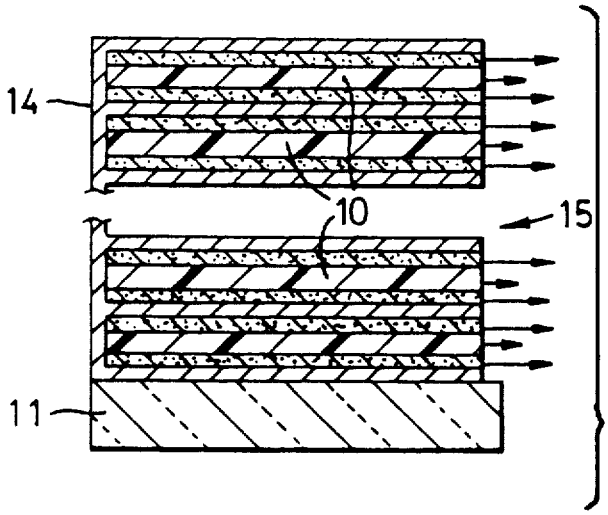
FIG. 12 is a schematic enlarged cross-sectional view of a multilayer extrinsic radioluminescent light source of the type shown in FIG. 11.

In FIG. 9 the TAS film 10 is "sandwiched" between phosphor films 16 thereby yielding two planar surfaces emitting radioluminescent light. The substrate 11, of glass, quartz or sapphire on which the phosphor is deposited is transparent to the light radiation emitted. In FIG. 10 an optically highly reflective film 14 is deposited between the substrate 11 and the phosphor 16 so as to reflect the light and thereby enhance the luminous exitance, ideally by a factor of two. In this case the phosphor and TAS films are transparent and non-absorbing to the light radiation emitted. In FIG. 11 the extrinsic light source is covered by optically highly reflective film 14 except at one narrow edge 15 so as to concentrate the light by total internal reflection and thus increase the luminous exitance. Once again, tacit in this description is the suitable combination of indices of refraction of the films to permit total internal reflection. FIG. 12 shows schematically, in enlarged section, a structure comprising very many extrinsic light source elements with enhanced luminous exitance stacked together to form a composite radioluminescent source with a large total light output.

We claim:

1. A radioluminescent light source comprising a radioactive element entrapped within an amorphous semiconductor matrix.

2. A radioluminescent light source according to claim 1 wherein the radioactive element is a beta-emitting element.

3. A radioluminescent source according to claim 1 wherein the radioactive element is tritium.

4. A radioluminescent source according to claim 3 wherein the matrix is amorphous silicon.

5. A radioluminescent source according to claim 3 wherein the amorphous semiconductor is doped or alloyed in an amount to generate light within a selected wavelength range.

6. An intrinsic radioluminescent light source according to claim 2 wherein the amorphous semiconductor matrix responds as a phosphor to the beta emission.

7. An extrinsic radioluminescent light source comprising a beta-emitting radioactive element occluded within an amorphous semiconductor matrix, the matrix constituting a secondary electron source responsive to beta emission, and a phosphor positioned to intercept secondary electrons from said electron source to generate light.

8. A composite intrinsic radioluminescent light source comprising a stratiform structure consisting of alternating layers of (a) an amorphous semiconductor containing an occluded beta-emitting radioactive element, and (b) optically reflective material, the amorphous semiconductor layers being totally enclosed by the reflective material layers except at one end of the structure, whereby light generated within the semiconductor layers is channelled towards said one end by total internal reflection.

9. A composite intrinsic radioluminescent light source according to claim 8, wherein the radioactive element is tritium.

10. A composite intrinsic radioluminescent light source according to claim 9, wherein the semiconductor is amorphous silicon.

11. A composite extrinsic radioluminescent light source comprising a stratiform structure consisting of alternating light emitting layers and layers of optically reflective material, each said light emitting layer comprising a beta-emitting radioactive element occluded within a semiconductor matrix, the matrix constituting a secondary electron source responsive to beta emission and being sandwiched between phosphor layers positioned to incept secondary electrons from the electron source to generate light, each said light emitting layer being totally enclosed by the optically reflective material save at one end of the structure, whereby light emitted is channelled towards said one end by total internal reflection.

* * * * *